United States Patent [19]

Stedman

[11] 4,049,079

[45] Sept. 20, 1977

[54] TRACTOR MOUNTED APPARATUS FOR PERFORMING AERIAL WORK TASKS

[75] Inventor: Robert N. Stedman, Chillicothe, Ill.

[73] Assignee: Caterpillar Tractor Co., Peoria, Ill.

[21] Appl. No.: 687,728

[22] Filed: May 19, 1976

[51] Int. Cl.[2] ..... B66F 11/04

[52] U.S. Cl. ..... 182/2; 212/17; 212/144

[58] Field of Search ..... 182/2, 141, 148; 212/8 R, 17, 144; 214/86 R, 1 E

[56] References Cited

U.S. PATENT DOCUMENTS

| | | | |
|---|---|---|---|
| 3,291,253 | 12/1966 | Wible | 182/2 |
| 3,637,043 | 1/1972 | Zwight | 182/2 |
| 3,828,939 | 8/1974 | Tranchero | 182/2 |
| 3,893,540 | 7/1975 | Beucher | 182/2 |
| 3,924,766 | 12/1975 | Canning | 182/2 |

*Primary Examiner*—Reinaldo P. Machado
*Attorney, Agent, or Firm*—Phillips, Moore, Weissenberger, Lempio & Majestic

[57] ABSTRACT

An aerial work task apparatus comprises a pair of laterally spaced lift arms pivotally mounted on the frame of a tractor and a double-acting lift cylinder pivotally interconnected between the frame and each lift arm. A platform, adapted to carry a workman thereon, is pivotally connected to the frame and to the lift arms by linkage means which function to raise and lower the platform substantially vertically above the tractor and to maintain the platform relative to ground level. In a first embodiment of the this invention, the linkage means comprises first and second pairs of links pivotally interconnected between the lift arms and the platform to form a parallelogram type linkage and a third pair of links pivotally interconnected between the first pair of links and the frame of the tractor. The third pair of links and the lift arms form a second parallelogram type linkage to aid in the above mentioned maintenance of the platform in parallel relationship relative to ground level. In a second embodiment of this invention, the linkage means comprises the above-mentioned first and second pairs of links and a tilt linkage normally associated with a loader bucket is substituted in lieu of the third pair of links. In both such embodiments, the platform is universally connected to the first pair of links by a single ball and socket connection whereas each of the second pair of links is connected to the platform by a ball and socket connection to thus provide a threepoint adjustable support for the platform, i.e., the second links each constitute a double-acting hydraulic cylinder.

20 Claims, 5 Drawing Figures

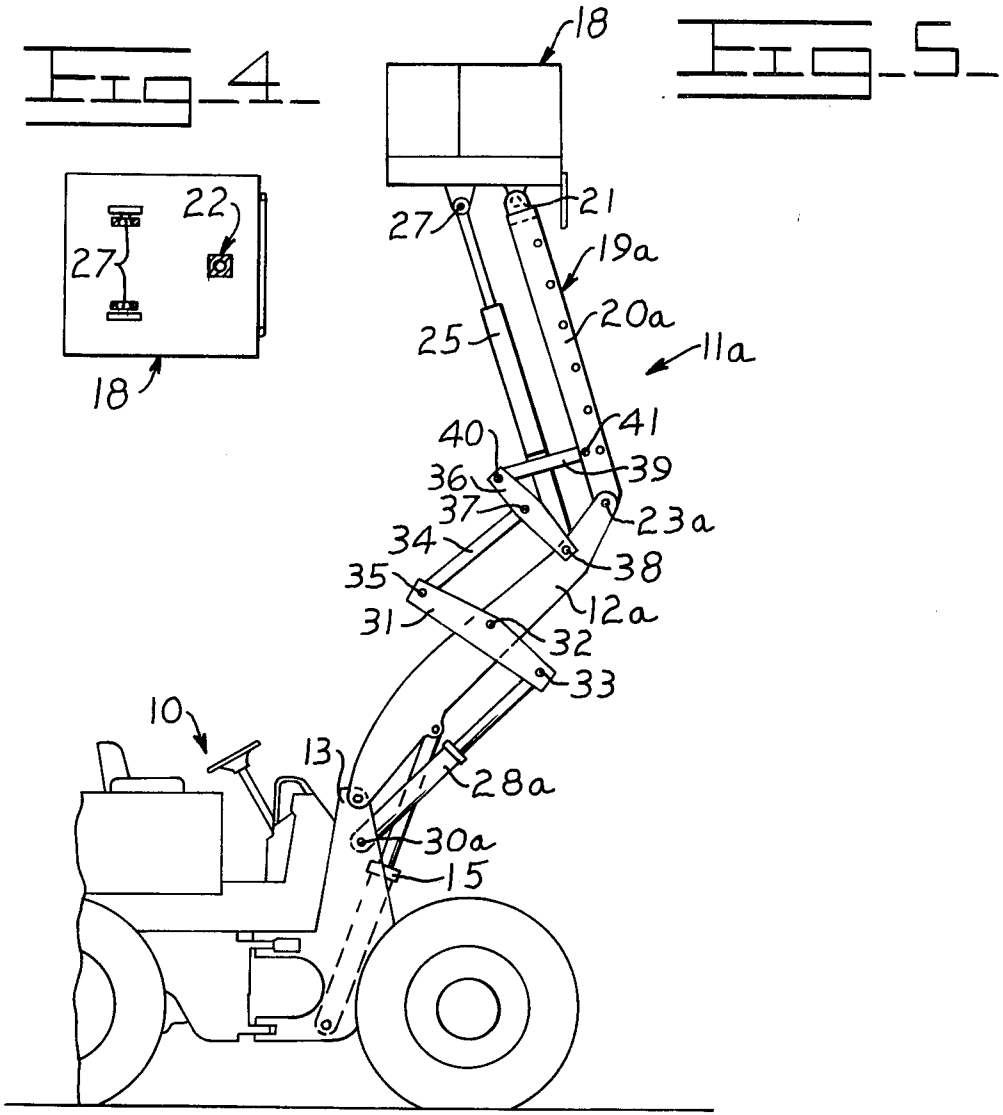
FIG. 5
FIG. 4
18
21
19a
20a
11a
41
39
23a
38
12a
32
33
28a
30a
15
13
10
27
25
40
36
37
34
35
31
22
27
18
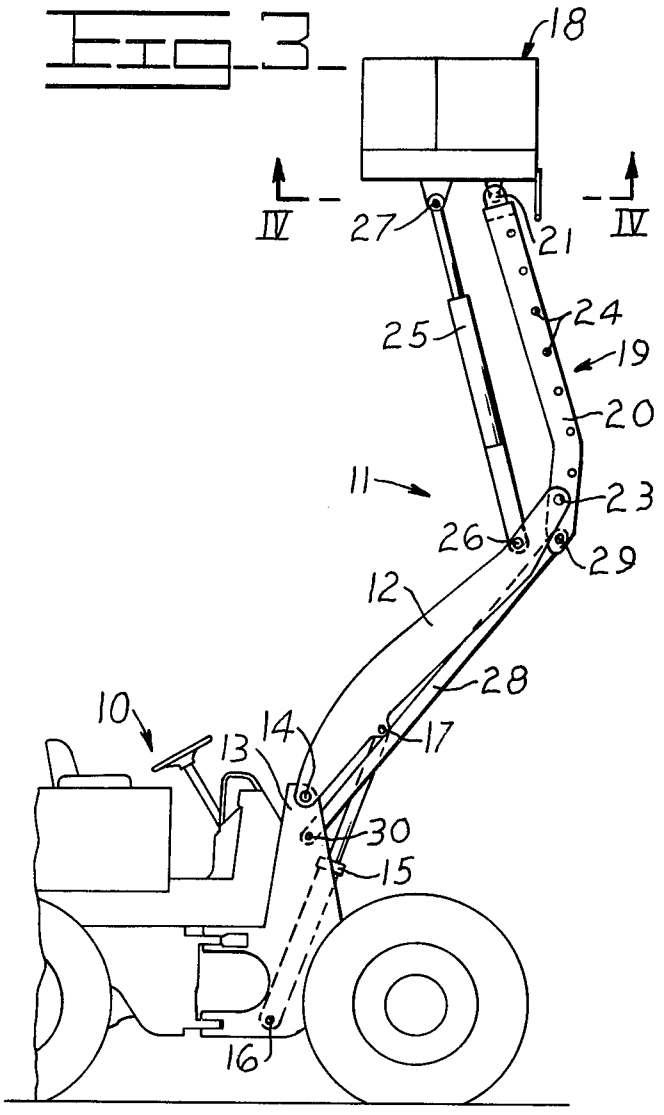
FIG. 3
IV
IV
18
21
24
19
20
23
29
28
26
25
27
11
12
17
30
15
14
13
16
10

TRACTOR MOUNTED APPARATUS FOR PERFORMING AERIAL WORK TASKS

BACKGROUND OF THE INVENTION

Conventional apparatus for performing aerial work tasks are generally complex and do not always provide a workman with a stabilized platform during ascent. For example, such apparatus normally swing in very pronounced arcs and do not move the platforms thereof vertically upwardly nor are the platforms maintained in parallel relationship to ground level when the platforms are moved from a lowered to a raised position. Furthermore, the second workman operating the controls for raising or lowering the platform is not always in a position to readily observe the same to assure that it is placed in proper disposition for a particular work task. Conventional apparatus of this type also require specially designed vehicles therefor and cannot be adapted for use with conventional vehicles, such as wheel- type loaders.

SUMMARY OF THE INVENTION

An object of this invention is to overcome the above, briefly described problems by providing an economical, compact and non-complex aerial work task apparatus which is adapted for attachment on the lift arms of a conventional wheel-type loader, for example. The lift arms are each adapted to be moved between a lowered and a raised position relative to ground level by a double-acting lift cylinder pivotally interconnected between the lift arm and the frame of the tractor. A platform, adapted to carry a workman thereon, is pivotally connected to the frame and the lift arms by linkage means for raising and lowering the platform at least substantially vertically above the vehicle while simultaneously maintaining the platform parallel relative to ground level.

The linkage means is adapted to be folded into closely compacted relationship within the confines of the lift arms, along with the platform, the facilitate transport thereof to a remote job site. Since the platform is moved by the linkage means substantially vertically upwardly, the operator of the tractor can clearly view the disposition of the platform and thus place the workman therein at the most advantageous position for performing a particular work task. In a first embodiment of this invention, the linkage means comprises first and second pairs of links pivotally interconnected between the platform and the lift arms and a pair of third links are pivotally interconnected between the frame of the vehicle and the first links. In a second such embodiment, the third links are replaced with a tilt linkage of the type normally utilized on a standard wheel-type loader.

BRIEF DESCRIPTION OF THE DRAWINGS

Other objects of this invention will become apparent from the following description and accompanying drawings wherein:

FIG. 3 is a view similar to FIG. 1, but illustrating the aerial work task apparatus in a raised position on the tractor;

FIG. 4 is an underside view of a platform of the aerial work task apparatus, taken in the direction of arrows IV—IV in FIG. 3; and FIG. 5 is a view similar to FIG. 3, but illustrating a modified linkage means employed in the aerial work task apparatus.

DETAILED DESCRIPTION

Figure 1:
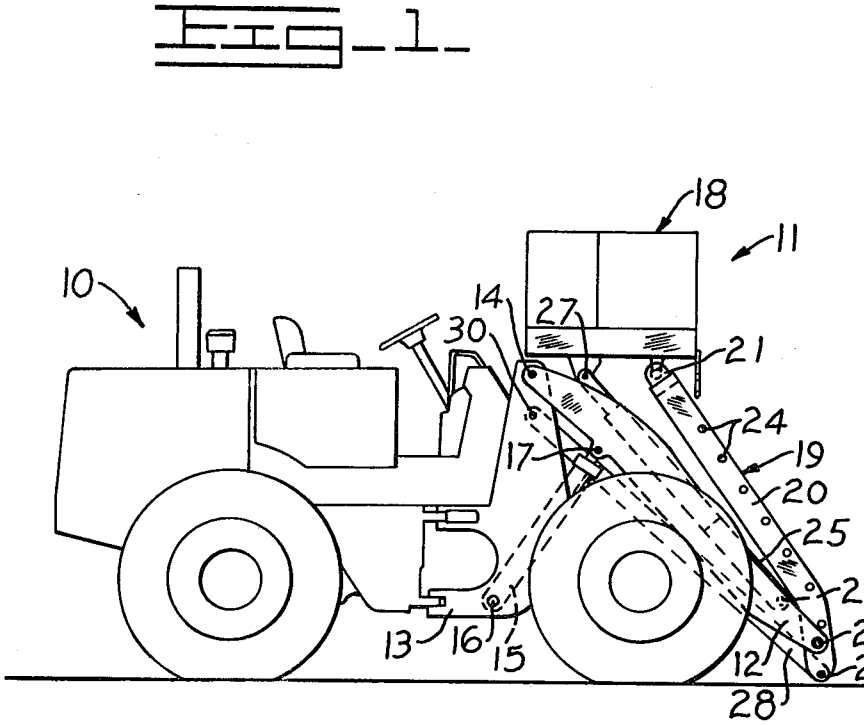
FIG. 1 is a side elevational view of an articulated tractor having the aerial work task apparatus of this invention mounted and maintained at a lowered position thereon.

FIG. 1 illustrates a standard articulated wheel-type tractor 10 having an aerial work task apparatus 11 mounted and disposed at a lowered position thereon. As will be hereinafter more fully explained, one of the features of this invention comprises the substitution of apparatus 11 in lieu of the standard bucket and attendant mechanisms employed on a conventional wheel- type loader. The loader normally comprises a pair of laterally spaced lift arms 12 pivotally mounted on a front frame 13 of tractor 10 by pivot pins 14 and a double-acting hydraulic cylinder 15 pivotally interconnected between the frame and each lift arm by pivot pins 16 and 17, respectively.

The lift arms form part of apparatus 11 and are adapted to be moved between the lowered and raised positions illustrated in FIGS. 1 and 3, respectively. The apparatus further comprises a platform means 18 connected to the lift arms by a linkage means, generally shown at 19. As shown in FIG. 1, the linkage means is adapted to be folded into closely compacted relationship within the confines of the tractor, along with the platform means, for stabilization and transport purposes.

Figure 2:
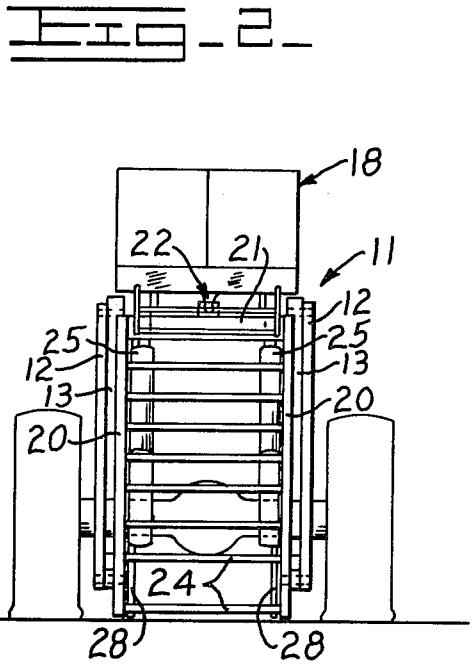
FIG. 2 is a front elevational view of the FIG. 1 tractor and aerial work task apparatus.

As more clearly illustrated in FIGS. 2 and 3, the linkage means comprises a pair of laterally spaced first links 20 having first or upper ends thereof secured together by a horizontally disposed cross-brace 21. The cross-brace is universally connected to the underside of platform means 18, adapted to carry a workman thereon, by a ball and socket connection 22 disposed intermediate the ends of the cross-brace. Each link 20 is connected to an upper end of a respective lift arm 12 by a pin 23. A plurality of equally spaced cross members 24 are secured between links 20 to rigidify the same and to provide ladder steps for ascent of a workman onto platform means 18.

Linkage means 19 further comprises a pair of second links 25 each pivotally mounted between a respective lift arm 12 and platform means 18 by pivot means comprising a pin 26 and a ball and socket connected 27, respectively. Each link 25 preferably comprises a double-acting hydraulic cylinder which may be selectively extended or retracted by operator-control means (not shown), to adjust the pitch, roll and yaw positions of the platform relative to ground level. Links 20 and 25 are positioned to form a first parallelogram-type linkage to aid in maintaining the platform horizontally relative to ground level upon raising and lowering thereof.

The linkage means further comprises a pair of third links 28 each pivotally interconnected between a second or lower end of a respective link 20 and frame 13 of the tractor by pivot pins 29 and 30, respectively. Each link 28 and an adjacent lift arm 12 will thus form a second parallelogram-type linkage which cooperates with the linkage formed by links 20 and 25 to aid in maintaining the horizontal disposition of platform means 18 during vertical movements thereof. As shown in FIG. 1, when cylinders 15 are retracted to collapse linkage means 19 to maintain the platform means at its lowered position, the folded linkage means and the platform will be maintained in closely compacted relationship within the confines of the lift arms.

Upon raising of the platform means from its FIG. 1 to its FIG. 3 position of operation, cylinders 15 are extending to thus raise lift arms 12. The raising of the lift arms will, in turn, function to raise platform 18 substantially vertically upwardly to retain the horizontal location of the center of gravity of the overall vehicle substantially the same to prevent tipping thereof. When tractor 10 is maintained in a non-level orientation on the ground, cylinders 25 may be selectively extended or retracted to universally level platform means 18 on the three-point suspension comprising ball and socket connections 22 and 27.

FIG. 5 illustrates a modified linkage means 19*a* wherein identical numerals are used to depict corresponding constructions, but with numerals in FIG. 5 depicting modified constructions being accompanied by an *a.* The linkage means comprises a pair of standard lift arms 12*a* for a conventional wheel-type loader and a pair of standard tilt linkages for the loaded bucket thereof (not shown). Each tilt linkage comprises a bellcrank 31 pivotally mounted intermediate its ends on a respective lift arm 12*a* by a pin 32.

A first end of the bellcrank is pivotally connected to the rod end of a link or double-acting hydraulic cylinder 15, pivoted on frame 13 by a pin 30*a,* by a pin 33 whereas the second end of the bellcrank is pivotally connected to a link 34 by a pin 35. Link 34 is further pivotally connected intermediate the ends of a lever 36 by a pin 37. One end of the lever is pivotally connected to lift arm 12*a* by a pin 38 whereas a second end of the lever is pivotally connected to a link 39 by a pin 40. Link 39 is further pivotally connected to a slightly modified link 20*a* by a pin 41.

The FIG. 5 linkage means, when collapsed to dispose platform 18 in its lowered position similar to that shown in FIG. 1, will dispose linkage means 19*a* and platform means 18 in a folded and compacted position within the confines of lift arms 12*a.* Upon extension of lift cylinders 15, bellcrank 31 will pivot clockwise about pivot pin 32 and lever 36 will pivot clockwise about pivot pin 38 under the influence of links 28*a,* 34 and 39. The platform will raise and be maintained in a general horizontal disposition relative to ground level by linkage means 19*a.* As above, links 25 preferably each constitute a double-acting hydraulic cylinder whereby universal adjustment of the platform can be effected. Each cylinder 28*a* necessarily constitutes a double-acting hydraulic cylinder or is spring-loaded to enable it to extend and retract upon raising and lowering of platform means 18.

What is claimed is:

1. An aerial work task apparatus mounted on a frame of a mobile vehicle comprising lift arm means pivotally mounted directly on said frame, lift cylinder means pivotally interconnected between said frame and said lift arm means for selectively moving said lift arm means between lowered and raised positions relative to ground level, platform means adapted to carry a workman thereon and linkage means pivotally interconnected between said frame, said lift arm means and said platform means for raising and lowering said platform means at least substantially vertically above said vehicle and for at least substantially maintaining said platform means parallel relative to ground level upon raising and lowering thereof, said linkage means being universally connected to said platform means and wherein said linkage means comprises adjustment means for selectively moving said platform means relative to said vehicle in pitch, roll and yaw directions for universal movement, first linkage means pivotally connected to said lift arm means and universally connected at a single point connection to said platform means and second linkage means, forming a parallelogram-type linkage with said first linkage means, pivotally connected to said lift arm means and universally connected to said platform means at a two point connection thereon.

2. The apparatus of claim 1 wherein said linkage means is foldable to place it and said platform means in closely compacted relationship within the confines of said lift arm means when said lift arm means is maintained in a lowered position thereof.

3. The apparatus of claim 1 wherein said lift arm means comprises a pair of laterally spaced lift arms and said lift cylinder means comprises a double-acting hydraulic cylinder pivotally interconnected between each lift arm and the frame of said vehicle.

4. The apparatus of claim 1 wherein said first linkage means is extensible and retactable.

5. The apparatus of claim 3 wherein said first linkage means comprises a pair of first links each pivotally interconnected between said platform means and a respective one of said lift arms and wherein said second linkage means comprises a pair of second links each pivotally interconnected between a respective one of said lift arms and said platform means, said first and second pairs of links forming a parallelogram-type linkage.

6. The apparatus of claim 5 wherein each of said second links constitutes a double-acting cylinder.

7. The apparatus of claim 5 wherein a cross-brace is secured between said first links and further comprising a single universal joint pivotally connecting said cross-brace to an underside of said platform means.

8. The apparatus of claim 5 further comprising a plurality of reinforcing members secured between said first links to provide ladder steps for ascent of a workman onto said platform means.

9. The apparatus of claim 5 wherein said linkage means further comprises a pair of third links each pivotally interconnected between said frame and a respective one of said first links, said third links and said lift arms forming a parallelogram-type linkage.

10. The apparatus of claim 5 wherein said linkage means further comprises a bellcrank pivotally mounted intermediate first and second ends thereof on each one of said lift arms, an extensible and retractable link pivotally interconnected between said frame and the first end of said bellcrank, a lever having a first end thereof pivotally mounted on each one of said lift arms, a link pivotally interconnected between each one of said first links and a second end of said lever and a link pivotally interconnected between the second end of said bellcrank and between the first and second ends of said lever.

11. The apparatus of claim 10 wherein each of the links pivotally interconnected between said bellcrank and said frame constitutes a double-acting hydraulic cylinder.

12. In combination with a tractor having a pair of laterally spaced lift arms pivotally mounted on a frame thereof to normally extend forwardly of said tractor and a double-acting cylinder pivotally interconnected between said frame and each of said lift arms for selectively moving such lift arm between lowered and raised positions relative to ground level, an apparatus for performing aerial work above said tractor comprising platform means adapted to carry a workman thereon and linkage means interconnected between said frame, said lift arms and said platform for selectively moving said platform vertically upwardly and away from said lift arms when said lift arms are moved from their lowered positions to their raised positions, said linkage means comprising a pair of first links each pivotally interconnected between said platform means and a respective one of said lift arms and a pair of second links each pivotally interconnected between a respective one of said lift arms and said platform means, said first and second pairs of links forming a parallelogram-type linkage.

13. The combination of claim 12 wherein said linkage means is universally connected to said platform means and wherein said linkage means comprises adjustment means for selectively moving said platform means relative to said tractor in pitch, roll and yaw directions of universal movement.

14. The combination of claim 13 wherein said linkage means is pivotally connected to said platform means at only three points thereon.

15. The combination of claim 12 wherein each of said second links constitutes a double-acting cylinder.

16. The combination of claim 12 wherein a cross-brace is secured between said first links and further comprising a single universal joint pivotally connecting said cross-brace to an underside of said platform means.

17. The combination of claim 12 wherein said linkage means further comprises a pair of third links each pivotally interconnected between said frame and a respective one of said first links, said third links and said lift arms forming a parallelogram-type linkage.

18. The combination of claim 12 wherein said linkage means further comprises a bellcrank pivotally mounted intermediate first and second ends thereof on each one of said lift arms, an extensible and retractable link pivotally interconnected between said frame and the first end of said bellcrank, a lever having a first end thereof pivotally mounted- on each one of said lift arms, a link pivotally interconnected between each one of said first links and a second end of said lever and a link pivotally interconnected between the second end of said bellcrank and between the first and second ends of said lever.

19. The combination of claim 18 wherein each of the links pivotally interconnected between said bellcrank and said frame constitutes a double-acting hydraulic cylinder.

20. The combination of claim 12 wherein said tractor constitutes an articulated wheel-type tractor.

* * * * *